United States Patent [19]

Gross

[11] Patent Number: 4,882,863

[45] Date of Patent: Nov. 28, 1989

[54] NONMAGNETIC COPYHOLDER AND CLIP

[75] Inventor: Richard L. Gross, Fox River Grove, Ill.

[73] Assignee: Wilson Jones Company, Chicago, Ill.

[21] Appl. No.: 100,512

[22] Filed: Sep. 24, 1987

[51] Int. Cl.[4] ..... B41J 11/64

[52] U.S. Cl. ..... 40/352; 40/357

[58] Field of Search ..... 40/341, 349, 351, 352, 40/353, 356, 357

[56] References Cited

U.S. PATENT DOCUMENTS

| | | | |
|---|---|---|---|
| 1,984,711 | 12/1934 | Van Alstyne | 40/352 |
| 2,181,615 | 11/1939 | Van Alstyne | 40/352 |
| 3,019,424 | 1/1962 | Goldwater et al. | 40/352 |
| 4,024,662 | 5/1977 | Krulwich | 40/352 |
| 4,329,799 | 5/1982 | Nagley | 40/352 |
| 4,365,431 | 12/1982 | Klaus et al. | 40/352 |
| 4,455,773 | 6/1984 | Denison | 40/357 |
| 4,656,764 | 4/1987 | Fengler | 40/352 |

*Primary Examiner*—Gene Mancene
*Assistant Examiner*—Michael Lynch
*Attorney, Agent, or Firm*—Pennie & Edmonds

[57] ABSTRACT

A plastic copyholder having a frame with track means and an arm having upper and lower surfaces. Adjustable elongated block means ride on the track means. Slide means in the block means permit unique pivoting and adjustment of the arm.

7 Claims, 5 Drawing Sheets

NONMAGNETIC COPYHOLDER AND CLIP

BACKGROUND OF THE INVENTION

A variety of arrangements for supporting foldable reader bars in adjustable positions have been proposed (U.S. Pat. Nos. 4,102,050; 4,267,656; 4,365,431; 1,175,448; and 694,389).

SUMMARY OF THE INVENTION

Broadly, the present invention is a foldable copyholder, preferably of assembled molded plastic parts, which includes an arrangement for moving the line guide up and down the copyholder face without the use of springs or magnetic means. The selected engagement of the stationary and moving parts is accomplished through sizing the parts, the elastic quality of the molded material, and other interactivity of parts as further described.

It is a feature that the line guide unit includes a movable track-carrying block and an extendable piece for accommodating the thickness of papers on the copyholder.

It is a further feature that the copyholder has a foldable stand which is firmly engageable in the copyholder frame mount when the stand is fully extended to its open position and by the application of modest force is readily moved to its folded position.

DESCRIPTION OF THE PREFERRED EMBODIMENT

Figure 1:
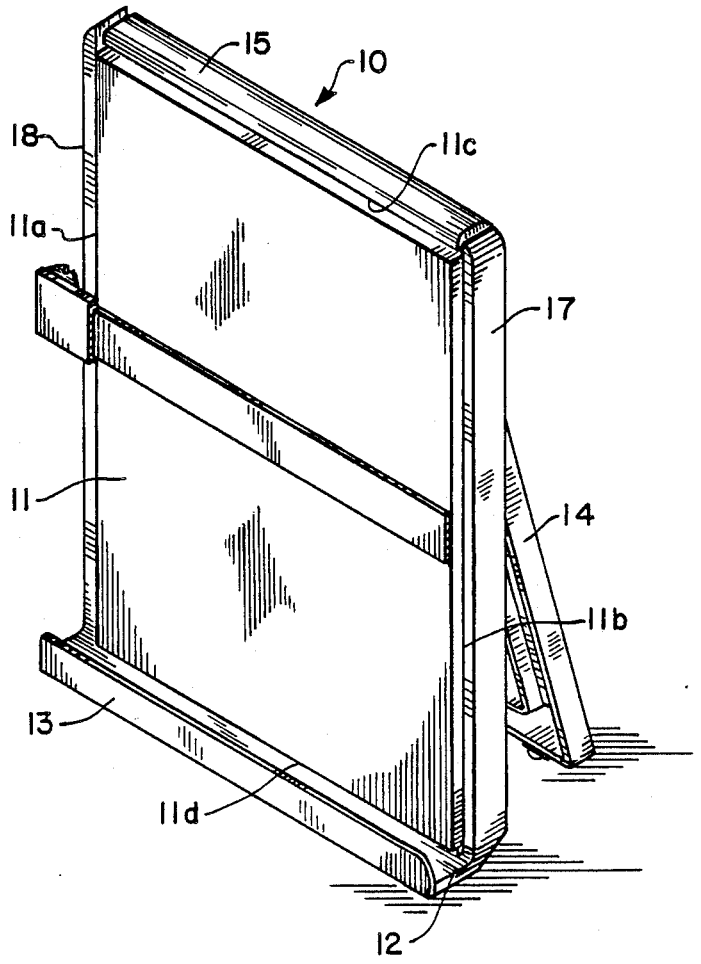
FIG. 1 is a perspective view of the copyholder in standing position.

In FIG. 1, copyholder 10 includes a planar sheet rest frame 11 including lower sheet support ledge 12, a lower sheet retaining bar 13, a foldable stand 14, and a movable line guide unit 16. Also shown are vertical frame grooves 11*a*, 11*b* and upper groove 11*c*. Frame 11 also includes vertical side pieces 17, 18 and top piece 15, all perpendicular to the plane of sheet rest frame 11. The frame 11 and other copyholder parts, as will be described hereinafter, are preferably molded plastic. Suitable plastics are A. B. S., styrene polypropylene, etc. The frame and other parts are relatively hard but sufficiently compressible and deflectable under load to permit the operations referred to herein. Parts that slide on one another are close fitting and rely on friction and movement arm forces to hold parts in selected positions. Interaction between parts, in static and dynamic conditions, including compressibility, deflectability, close tolerances, friction and torque are all herein referred to as "interactivity".

Figure 3:
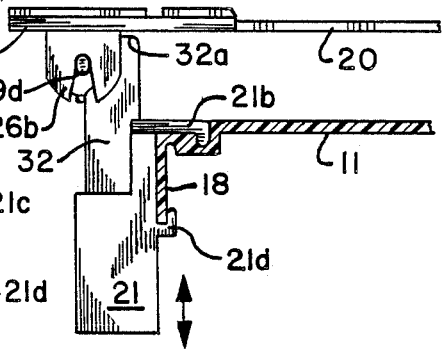
FIG. 3 is a partial side elevational view of the line guide unit engaging the copyholder frame.
Figure 2:
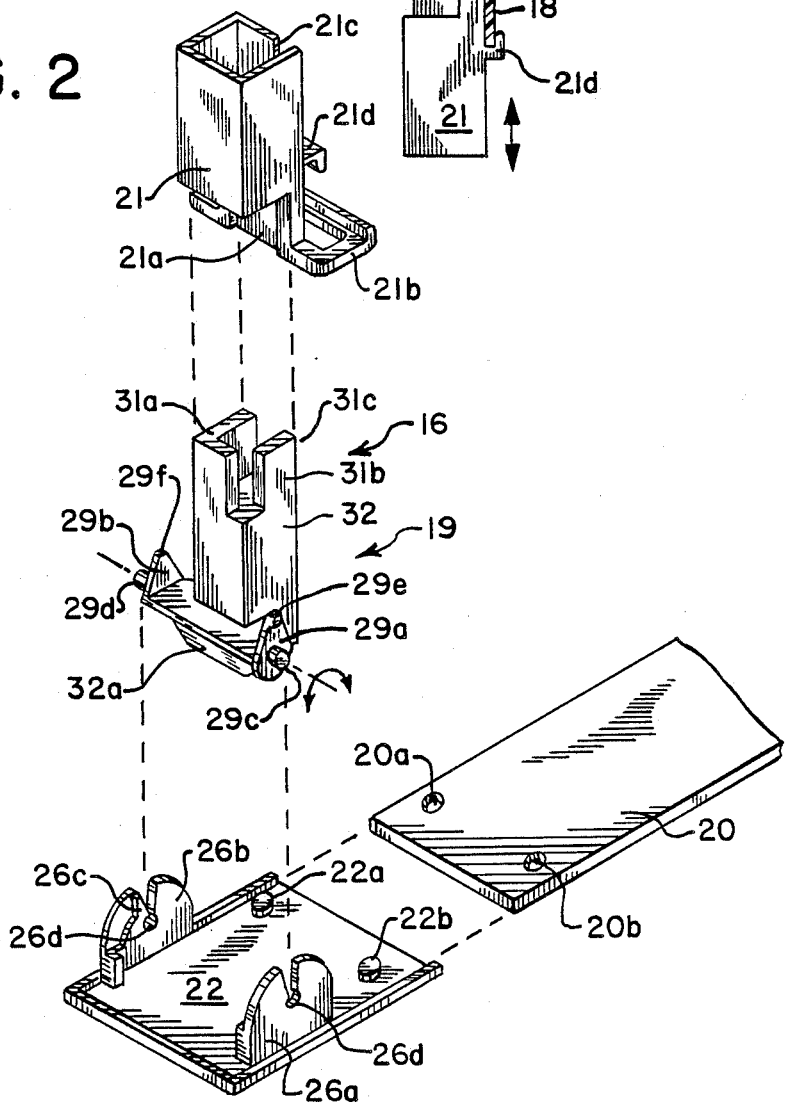
FIG. 2 is an exploded view of the line guide unit.

Turning to FIGS. 2 and 3, line guide unit 16 includes a slidable plastic frame mount 19 pivotally connected to mount plate 22 and positioned to slide up and down with interactivity in plastic block 21. Block 21 slides on side piece 17 or 18 in close frictional tolerance with the weight of the arm 20 providing a torque to assist in holding the block 21 in any selected position. Guide unit 16 also includes plastic arm 20. Arm mount plate 22, in turn, includes two (2) spaced-apart axle mount pieces 26*a*, 26*b* secured to the underside of plate 22. Arm 20 carries holes 20*a*, 20*b* for connecting plate 22 to arm 20 by means of heat-staking posts 22*a* and 22*b*. Slidable frame mount 19 has two (2) pivot plates 29*a*, 29*b* spaced-apart to fit adjacent and inside mount pieces 26*a*, 26*b* with plate axles 29*c*, 29*d* snap fitting in plate receiving opening 26*c*, 26*d*. Plate projections 29*e*, 29*f* snap over plate ridges 26*c* and 26*d* (not shown) to hold frame mount 19 in a right angle orientation to arm 20. In such snap over position plate projection 29*f* is just to the right of plate ridge 26*c* (FIG. 2).

Frame mount 19 also includes body portion 32 with opposing L-shaped upstanding piece 31*a* and upstanding flat piece 31*b*. Flat piece 31*b* carries ledge tab 31*c*. Pieces 31*a*, 31*b* are deflectable about body 32 to fit with close frictional tolerances into box unit 21 having groove 21*a*, frame grip rack 21*b*, slot 21*c* and frame hook 21*d*. Frame mount 19 including L-shaped piece 31*a* and deflectable flat piece 31*b* are inserted into body unit 21 alonge groove 21*a* until tab 31*c* reaches the lower end of slot 21*c* (as shown in FIG. 2) which end is just above frame hook 21*d*. Once hook 21*d* reaches this point, frame mount 19 and box unit 21 are in snap engagement but can continue to move telescopically until grip rack 21*b* engages the surface of plate 22 or can move further apart until tab 31*c* is snapped into slot 21*c* (through tab 31*c* deflection). It is seen that when the end 32*a* of body 32 engages plate 22 and plate projection 29*e*, 29*f* are in snap position the plate 22 and arm 20 are in right angle orientation.

Turning to FIG. 3, the box unit 21 as mounted on rest frame 11 and particularly its vertical side piece 18. Body 32 is adjustable in unit 21 to accommodate for the desired spacing between arm 20 and rest frame 11.

Figure 4:
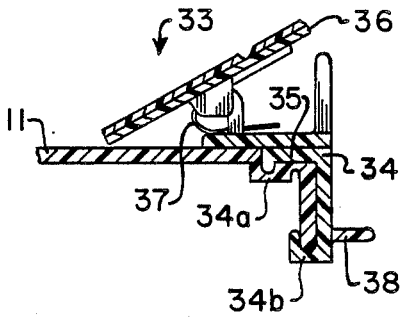
FIG. 4 is a sectional view of a clip unit engaging a section of the copyholder frame.
Figure 5:
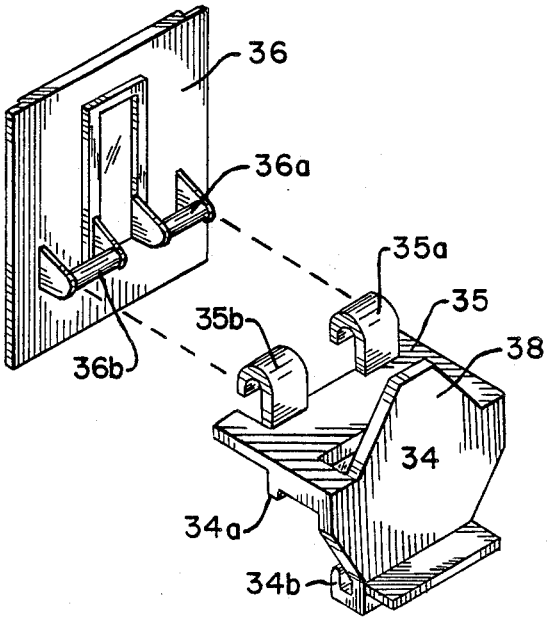
FIG. 5 is an exploded perspective view of the clip unit.

FIGS. 4 and 5 show clip unit 33 including frame groove 11, slide frame 34, hinge extension 35 and pivotal clamp plate 36. Slide frame 34 has frame engaging rails 34*a*, 34*b*, hinge extension 35 has curved bearing hooks 35*a*, 35*b* and plate 36 has axles 36*a*, 36*b* to receive hooks 35*a*, 35*b*. Spring 37 urges plate 36 in a counterclockwise direction as shown in FIG. 4 to grip and hold sheets of paper or other objects against frame 11. Also shown is finger grip area 38 for facilitating squeezing unit 33 to overcome spring 37 and release engaged sheets of paper (not shown) between frame rest 11 and clamp plate 36.

Figure 6:
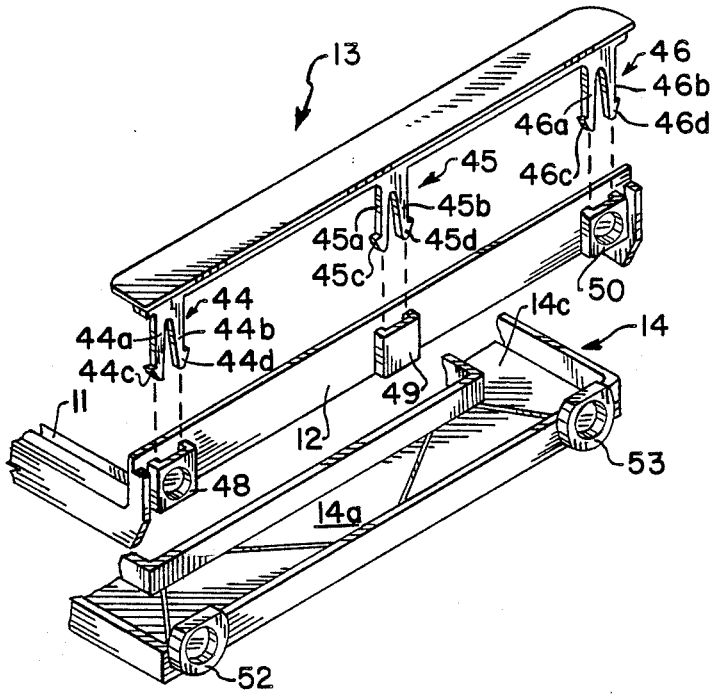
FIG. 6 is a perspective exploded view showing the frame-stand and copyholder retaining bar.

In FIG. 6, there is shown rest frame 11, U-shaped stand 14 and support ledge 12. Also shown is retaining bar 13 which includes plastic projections 44, 45 and 46 each of which has spaced-apart projection arms 44*a*, 44*b*, 45*a*, 45*b* and 46*a*, 46*b* which arms are housed in frame arm receivers 48, 49, 50 sized to tension arms 44*a*, 44*b*, 45*a*, 45*b* and 46*a*, 46*b* toward one another to enable arms 44*a*, 44*b* and 45*a*, 45*b*, 46*a*, 46*b* to be inserted into arm receivers 48, 49, 50 until arm barbs 44*c*, 44*d*; 45*c*, 45*d*; 46*c*, 44*d* snap fit, for assembly purposes, by projecting below receivers 48, 49 and 50. Also shown are stand feet 52 and 53. U-shaped stand 14 includes base section 14*a* and stand legs 14*b* and 14*c*.

Figure 7:
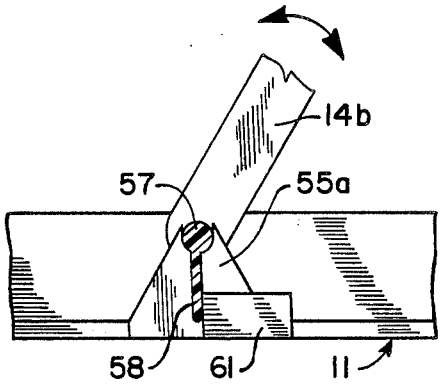
FIG. 7 is a side elevational view of the frame hinge in its open standing position.
Figure 8:
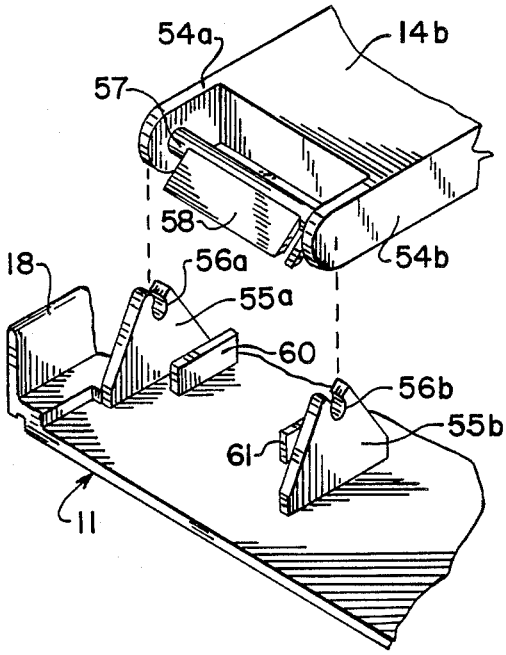
FIG. 8 is a partial perspective view of the stand and frame hinge arrangement in an exploded view.

Turning in particular to FIGS. 7 and 8, U-shaped stand leg 14b has upper end pairs of spaced-apart projection pieces 54a, 54b having a rod 57 affixed between them. Mounted in and extending between pieces 54a, 54b are upstanding hinge rod bearing sections 55a and 55b attached to or formed in the back side of rest frame 11. Upstanding sections 55a, 55b include grooves 56a, 56b for receiving and holding rod 57 which carries integral bracing piece 58. Rod 57 fits through snap-in and snap-out engagement. Frame leg 14c is similarly constructed. Pivotal movement of legs 14b, 14c is limited by two spaced-apart frame uprights 60, 61 as rod element 58, an integral part of rod 57, engages them.

Preferably all parts of copyholder 10 are made of plastic parts without metal springs, fasteners or the like for ease of assembly, operation and durability.

We claim:

1. A copyholder including a stand having a plastic frame with a surface positioned in a non-horizontal position for supporting a sheet and guide arm having upper and lower surfaces movable to various locations on the surface comprising (a) track means positioned in a non-horizontal position on the frame; and (b) plastic guide arm mount means movable along the track means, the mount means including (i) rail means engaging the track means through torque and friction;

(ii) elongated block means attached to or integral with such rail means having an elongated internal opening therein;

(iii) slide means frictionally telescopically slidable in the block means opening to selected locations where the slide means are frictionally maintainable in plastic-to-plastic contact with the block means;

(iv) first pivot means on one end of the slide means;

(v) second pivot means positioned below the lower surface of the arm for pivotally mounting the arm on the slide means, whereby the arm may be movable along the frame surface and may be rotated away from the sheet on the surface.

2. The copyholder of claim 1 having in addition retaining bar means for supporting sheets on the copyholder sheet-support surface.

3. The copyholder of claim 1 having a foldable stand movable from a closed to an open position which stand is pivoted on the back of the frame in which the frame carries spaced-apart uprights and the stand carries plate means rotatable to engage the uprights in the stand-open position.

4. A copyholder comprising (a) plastic planar frame means capable of supporting a stack of sheets of paper with said frame means including a side piece;

(b) plastic block means including rail means movable along the side piece and in engagement with the side piece due to the compressibility and deflectability of the side piece or the block means and such side piece and block means being maintainable in selected relative plastic-to-plastic positions relative to one another by torque and friction;

(c) extension means having a lower end and an upper end frictionally engageable in the block means and extending therefrom for movement substantially perpendicular to the plane of the frame means;

(d) pivotal plate means pivotally mounted on the upper end of the extension means; and (e) arm means secured to the plate means whereby the arm means (1) may be moved along the side piece and held, through compression of the side piece or block means, in a selected position and (2) may be moved toward or away from the planar frame as the extension means moves in the block means.

5. The copyholder of claim 4 in which the block means has a passageway and the extension means includes two upstanding spaced apart pieces which are sized and spaced to extend into and springingly engage the passageway.

6. The copyholder of claim 4 having in addition a dual-leg hinged stand rotatable to a folded closed position and an extended open position with a leg-mounted plate on the stand which is rotatable into groove means on the frame to hold the stand in its open position.

7. The copyholder of claim 4 having in addition a clip means for holding objects slidably on the frame means.

* * * * *